US006348232B1

(12) United States Patent
Chida et al.

(10) Patent No.: US 6,348,232 B1
(45) Date of Patent: Feb. 19, 2002

(54) SPRAYING ROBOT SYSTEM AND SPRAYING METHOD WHEREIN SPRAY CONDITIONS ARE DETERMINED BY USING COMPUTER

(75) Inventors: Itaru Chida; Masayuki Itoh, both of Kawasaki; Keizoh Honda, Ebina; Takeshi Takahara; Yamato Kaminaka, both of Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/284,474

(22) PCT Filed: Oct. 21, 1997

(86) PCT No.: PCT/JP97/03796

§ 371 Date: Apr. 21, 1999

§ 102(e) Date: Apr. 21, 1999

(87) PCT Pub. No.: WO98/17837

PCT Pub. Date: Apr. 30, 1998

(30) Foreign Application Priority Data

Oct. 21, 1996 (JP) ..... 8-278434

(51) Int. Cl.[7] ..... C23C 4/12
(52) U.S. Cl. ..... 427/8; 427/446
(58) Field of Search ..... 427/446, 8; 118/302, 118/323, 324, 668, 698

(56) References Cited

U.S. PATENT DOCUMENTS

| | | | | |
|---|---|---|---|---|
| 4,358,471 A | * | 11/1982 | Derkacs et al. | 427/9 |
| 5,208,431 A | | 5/1993 | Uchiyama et al. | 219/162.65 |
| 5,600,759 A | * | 2/1997 | Karakama | 395/87 |

FOREIGN PATENT DOCUMENTS

| | | | |
|---|---|---|---|
| JP | 2-80546 | | 3/1990 |
| JP | 4-120259 | | 4/1992 |
| JP | 6-15448 | | 1/1994 |
| JP | 6-93403 | | 4/1994 |
| JP | 7-218148 | * | 8/1995 |
| JP | 8-74443 | | 3/1996 |
| JP | 8-120436 | | 5/1996 |

OTHER PUBLICATIONS

Shima et al., "System Technology and Control Technology Of Mitsubishi Heavy Industries, Ltd.", *Mitsubishi Juko Giho,* vol. 22, No. 6, pp. 4–35, (1985) (no month date).

Masuda et al., "Development of Turbin Blade FMS", *Mitsubishi Heavy Industries Reveiw,* vol. 22, No. 6, pp. 105–112, (1985) (no month date).

Konishi, "Expert System And Its Practical Application", *R&B Kobe Steel Engineering Reports,* vol. 40, No. 3, pp. 5–8, (1990) (no month date).

* cited by examiner

*Primary Examiner*—Katherine A. Bareford
(74) *Attorney, Agent, or Firm*—Foley & Lardner

(57) ABSTRACT

An object of the present invention is to provide a thermal spraying robot system capable of automatically determining spraying conditions according to the shape of a workpiece. Shape data on a workpiece (9) and material data on a thermal spray material are entered by operating a data input unit (1). A spray condition database 3 stores a plurality of spray parameters for kinds of thermal spray materials and for qualities of sprayed coatings. A path calculating unit (4) selects values of spray parameters from the spray condition database (3), and then calculates a path for a thermal spraying gun (14) according to a predetermined program on the basis of the shape data on the workpiece and the selected values of the spray parameters. The path calculating unit (4) decides whether or not a thermal spraying operation can be carried out by moving the thermal spraying gun along a calculated path. If it is decided that the thermal spraying operation is feasible, a thermal spraying apparatus 10 carries out the thermal spraying operation in which the thermal spraying gun is moved along the calculated path.

1 Claim, 8 Drawing Sheets

SPRAYING ROBOT SYSTEM AND SPRAYING METHOD WHEREIN SPRAY CONDITIONS ARE DETERMINED BY USING COMPUTER

RELATED APPLICATIONS

This application is a national stage application of PCT/JP97/03796, filed Oct. 21, 1997.

TECHNICAL FIELD

The present invention relates to a thermal spraying method using a computer for automatically determining spray conditions on the basis of data on a thermal spray material and the shape of a workpiece to be subjected to thermal spraying, and a thermal spraying robot system for carrying out the thermal spraying method.

BACKGROUND ART

It is an imperative problem to keep the inlet temperature of a gas turbine at temperatures not lower than 1300° C. to improve the power generating efficiency of a gas-turbine power plant. Efforts have been made to enhance the refractory quality of liners and transition pieces for combustors, vanes and blades, which are exposed to a high-temperature gas, to solve such a problem, and it is urgently necessary to develop heat-resistant materials, i.e., heat-resistant alloys. The withstandable temperatures of state-of-the-art heat-resistant alloys are 850° C. at the highest. Presently available heat-resistant alloys are not necessarily satisfactory particularly in respect of resistance to high-temperature oxidation and high-temperature corrosion.

Technique intended to deal with raising the inlet temperature of gas turbines coats the surfaces of parts with a ceramic material having a small conductivity by thermal spraying. This technique is called thermal barrier coating (hereinafter abbreviated to "TBC"). TBC has effect on suppressing substantial rise in the temperature of alloy materials. The effect in thermal insulation of TBC is considered to lower the temperature of member by a temperature in the range of 50 to 100° C.

TBC has been applied to combustors and transition pieces used in gas turbine power plants. However, heat insulating ceramic materials have values of physical properties greatly different from those of heat-resistant alloys, which causes the separation of coating layers from base metals. To solve such a problem and to enhance the reliability of parts, homogeneous coating films having high adhesion must be formed.

When coating the inner surfaces of liners of combustors or the inner transition pieces by thermal spraying, the shapes of the liners and the transition pieces place restrictions on thermal spraying and hence it is difficult to carry out thermal spraying without changing the distance between a spraying gun and a workpiece, and the inclination of a spraying gun to the surface of a workpiece and, consequently, it is difficult to form satisfactory coatings over the surfaces of workpieces. To solve such a problem, trials have been made to control a spraying gun automatically by a robot. Teaching of a path for a thermal spraying gun for the shape of each workpiece is necessary to maintain the distance between the thermal spraying gun and the workpiece constant and to maintain the thermal spraying gun perpendicular to the surface of the workpiece throughout a thermal processing process. Therefore, the development of programs requires much time, and a new program must be developed for every new workpiece.

Accordingly, it has been desired to develop a thermal spraying robot system capable of automatically determining spraying conditions and a path for a thermal spraying gun suitable for the shape of every workpiece. However, as mentioned above, when processing the liners and transition pieces of combustors by thermal spraying, interference between the thermal spraying gun and a workpiece and the ability of a thermal spraying gun driving mechanism place many restrictions on thermal spraying to coat the inner surfaces of workpieces; that is, the distance between the thermal spraying gun and the workpiece and the angle of the thermal spraying gun to the workpiece cannot be kept in optimum ranges and the thermal spraying gun cannot be moved at a constant moving velocity. Any thermal spraying robot system capable of automatically determining spraying conditions according to the shape of the workpiece has not yet been provided because of such restrictions.

The present invention has been made in view of the foregoing circumstances and it is therefore an object of the present invention to provide a thermal spraying robot system capable of automatically determining spraying conditions according to the shape of a workpiece.

SUMMARY OF THE INVENTION

With the foregoing object in view, the present invention provides a thermal spraying robot system comprising an input unit for entering shape data on the shape of a workpiece and material data on a thermal spray material, a spray condition database storing values of a plurality of spray parameters dominating the qualities of sprayed coatings and corresponding to qualities of sprayed coatings for thermal spray materials, a path calculating unit for selecting values of the spray parameters stored in the spray condition database and calculating a path for a thermal spraying gun on the basis of the selected values of the spray parameters and the shape data on the workpiece, and a thermal spraying apparatus including the thermal spraying gun, for carrying out a thermal spraying operation on the basis of the selected values of the spray parameters and a path for the thermal spraying gun calculated by the path calculating unit.

The plurality of spray parameters include, as principal parameters, at least spray distance d between the workpiece and the thermal spraying gun, angle θ between the thermal spraying gun and the workpiece and moving velocity v of the thermal spraying gun relative to the workpiece. The path calculating unit calculates a path for the thermal spraying gun on the basis of the selected values of the principal parameters.

The values of the plurality of spray parameters stored in the spray condition database include optimum values specifying optimum spray conditions, and allowable values specifying allowable spray conditions for providing sprayed coatings of allowable qualities inferior to qualities of sprayed coatings formed by thermal spraying under the optimum spray conditions. The path calculating unit selects the optimum values of the spray parameters at the beginning.

The path calculating unit changes the optimum value of at least one of the principal parameters for the allowable value when it is impossible to calculate a path for the thermal spraying gun on the basis of the optimum values of the principal parameters, and recalculates a path for the thermal spraying gun.

The path calculating unit changes the optimum values of the principal parameters excluding at least one of the principal parameters for the allowable values when it is impossible to calculate a path for the thermal spraying gun on the basis of the optimum values of the principal parameters, and recalculates a path for the thermal spraying gun.

The input unit further has a function to specify the principal parameter having the optimum value to be kept unchanged.

If it is impossible to calculate a path for the thermal spraying gun even if the optimum values of all the principal parameters are changed for the allowable values of the same, the path calculating unit uses values of the principal parameters other than the allowable values and recalculates a path for the thermal spraying gun by using the values of the principal parameters other than the allowable values.

The thermal spraying robot system further comprises a display means for displaying, when the optimum value of at least one of the plurality of principal parameters is changed for the allowable value, the principal parameter which has been adjusted, in which the input unit further has a function to determine whether or not thermal spraying is to be executed by using the changed principal parameter.

The present invention provides a thermal spraying method using a thermal spraying apparatus provided with a thermal spraying gun, and a computer for determining spray conditions, comprising: a data entering step of entering shape data on the shape of a workpiece and material data on a thermal spray material, selecting values of spray parameters corresponding to the entered material data on the thermal spray material from a spray condition database storing values of a plurality of spray parameters dominating qualities of sprayed coatings and corresponding to qualities of sprayed coatings for thermal spray materials, a path calculating step of calculating a path for the thermal spraying gun on the basis of the selected values of the spray parameters and the shape data on the workpiece according to a predetermined program, a decision step of deciding whether or not thermal spraying can be carried out by moving the thermal spraying gun along the calculating path, and a thermal spraying step of carrying out a thermal spraying operation on the basis of the selected values of the spray parameters and the calculated path for the thermal spraying gun.

The plurality of spray parameters include, as principal parameters, at least spray distance d between the workpiece and the thermal spraying gun, angle θ between the thermal spraying gun and the workpiece and moving velocity v of the thermal spraying gun relative to the workpiece.

The values of the plurality of spray parameters stored in the spray condition database include optimum values specifying optimum spray conditions, and allowable values specifying allowable spray conditions for providing sprayed coatings of allowable qualities inferior to the qualities of sprayed coatings formed by thermal spraying under the optimum spray conditions. The optimum values of the spray parameters are selected at the beginning in the selecting step.

If it is decided in the decision step that it is impossible to carry out thermal spraying, the selecting step and the path calculating step are executed at least one cycle, and at least one of the values of the spray parameters selected in the second and the following cycles of the selecting step is an allowable value selected instead of the optimum value.

The present invention provides a product produced by coating a workpiece with a sprayed coating formed by a thermal spraying method using a thermal spraying apparatus having a thermal spraying gun and a computer for determining spray conditions, and comprising a data entering step of entering shape data on the shape of a workpiece and material data on a thermal spray-material, a selecting step of selecting values of spray parameters corresponding to the entered material data on the thermal spray material from a spray condition database storing values of a plurality of spray parameters dominating qualities of sprayed coatings and corresponding to qualities of sprayed coatings for thermal spray materials, a path calculating step of calculating a path for the thermal spraying gun on the basis of the selected values of the spray parameters and the shape data on the shape of the workpiece according to a predetermined program, a decision step of deciding whether or not thermal spraying can be carried out by moving the thermal spraying gun along the calculating path, and a thermal spraying step of carrying out a thermal spraying operation on the basis of the selected values of the spray parameters and the calculated path for the thermal spraying gun.

The workpiece is a combustor liner for a combustor or a transition piece included in a gas turbine power plant.

According to the present invention, spray conditions can selectively be determined for all kinds of shapes of workpieces without distinction between two-dimensional shapes and three-dimensional shapes, a path for the thermal spraying gun can be calculated and a thermal spraying operation can be carried out. The time necessary for the development of a thermal spraying program can be reduced.

BEST MODE FOR CARRYING OUT THE INVENTION

A referred embodiment of the present invention will be described with reference to FIGS. 1 to 10.

Figure 1:
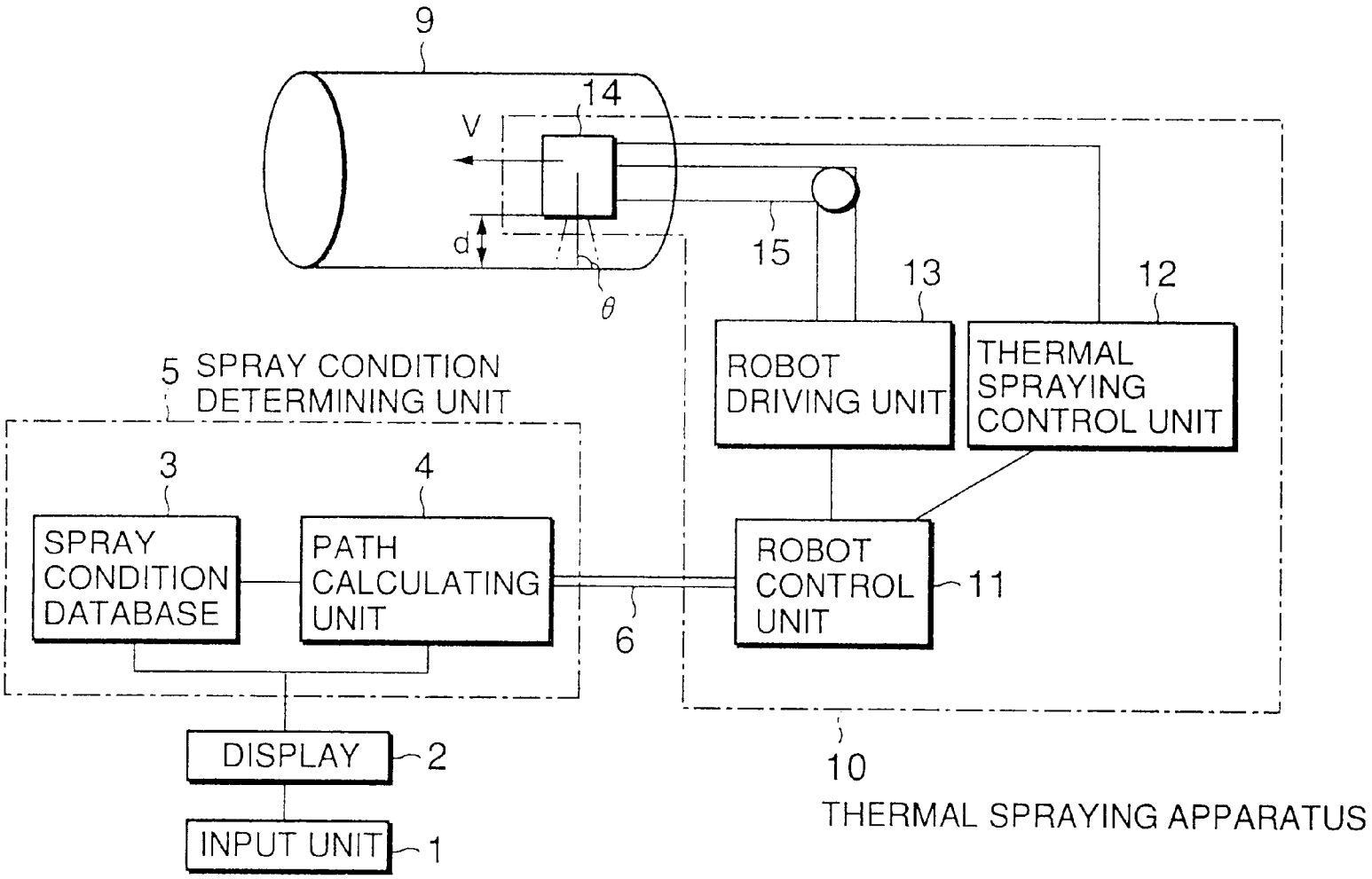
FIG. 1 is a block diagram of a thermal spraying robot system in a preferred embodiment according to the present invention.

The construction of a thermal spraying robot system will be described with reference to FIG. 1. Referring to FIG. 1, the thermal spraying robot system comprises an input unit 1 for entering shape data on the shape of a workpiece 9 to be subjected to thermal spraying and material data on a thermal spray material, a spray condition database 3 storing a plurality of spray parameters for kinds of thermal spray materials, a thermal spraying apparatus 10 for processing the workpiece 9 by thermal spraying, and a path calculating unit 4 for calculating a path for a thermal spraying gun 14 included in the thermal spraying apparatus 10. The spray condition database 3 and the path calculating unit 4 constitute a spray condition determining unit 5.

The thermal spraying apparatus 10 comprises the thermal spraying gun 14 for spraying the workpiece 9 with droplets of a thermal spray material, and an arm unit 15 holding the thermal spraying gun 14 to move the same. The arm unit is driven by a servomotor, not shown. The thermal spraying apparatus 10 has a robot driving unit 13 including a driver for driving the servomotor. The thermal spraying gun 14 is controlled by the robot driving unit 13 for movement in vertical and horizontal directions and turning motions.

The thermal spraying apparatus 10 has a thermal spraying control unit 12 for controlling parameters indicating the operating condition of the thermal spraying gun 14, i.e., parameters other than principal parameters, which will be described later, such as current, voltage, gas flow and such.

The robot driving unit 13 and the thermal spraying control unit 12 are connected to a robot control unit 11 which in turn is connected through a data transfer unit 6 to the spray condition determining unit 5. The robot control unit 11 controls the thermal spraying gun 14 on the basis of spray condition data determined by the spray condition determining unit 5.

The thermal spraying apparatus 10 is a robot provided with a feedback control system to which spray condition data (a path for the thermal spraying gun and spray parameters) is transferred as desired values from the spray condition determining unit 5.

A display 2, such as a CRT, is connected to the spray condition determining unit 5 and the input unit 1 to display information provided by the spray condition determining unit 5 and input data entered by operating the input unit 1.

The spray condition database 3 will be described hereinafter. The spray condition database 3 includes Tables 1 and 2 for thermal spray materials. Tabled 1 and 2 contain values of a plurality of spray parameters specifying spray conditions and determining thermal spray quality for $ZrO_2$–8% wt.$Y_2O_3$, and W and Mo, respectively. The values of the spray parameters include "optimum values" specifying optimum spray conditions A for forming optimum sprayed coatings, and "allowable values" specifying allowable spray conditions for forming sprayed coatings of allowable qualities inferior to those of optimum sprayed coatings. The allowable spray conditions are classified into primary conditions B for forming sprayed coatings of qualities comparable to those of sprayed coatings formed by thermal spraying conforming to the optimum spray conditions A, and secondary conditions C for forming sprayed coatings of qualities inferior to those of sprayed coatings formed by thermal spraying conforming to the primary conditions B.

TABLE 1

Spray Condition Database (For $ZrO_2$-8% wt. $Y_2O_3$)

| Spray Parameters | Optimum conditions (A) | Primary conditions (B) | Secondary conditions (C) |
|---|---|---|---|
| Spray distance (mm) | 95–100 | 80–120 | 60–150 |
| Moving velocity (mm/s) | 190–210 | 150–300 | 100–400 |
| Spraying angle (deg) | 80–100 | 60–120 | 45–135 |
| Current (A) | 580–620 | 520–700 | 400–800 |

TABLE 1-continued

Spray Condition Database (For $ZrO_2$-8% wt. $Y_2O_3$)

| Spray Parameters | Optimum conditions (A) | Primary conditions (B) | Secondary conditions (C) |
|---|---|---|---|
| Voltage (V) | 58–62 | 55–70 | 50–80 |
| Plasma gas: Ar (l/min) | 38–42 | 35–50 | 30–70 |
| Auxiliary gas: $H_2$ (l/min) | 6.5–7.5 | 5–9 | 3–14 |

TABLE 2

Spray Condition Database (For W and Mo)

| Spray Parameters | Optimum conditions (A) | Primary conditions (B) | Secondary conditions (C) |
|---|---|---|---|
| Spray distance (mm) | 95–100 | 80–110 | 60–130 |
| Moving velocity (mm/s) | 190–210 | 150–300 | 100–400 |
| Spraying angle (deg) | 80–95 | 75–105 | 55–125 |
| Current (A) | 580–620 | 520–700 | 400–800 |
| Voltage (V) | 58–62 | 55–70 | 50–80 |
| Plasma gas: Ar (l/min) | 48–52 | 40–60 | 30–70 |
| Auxiliary gas: $H_2$ (l/min) | 18–22 | 15–25 | 10–30 |

Figure 6:
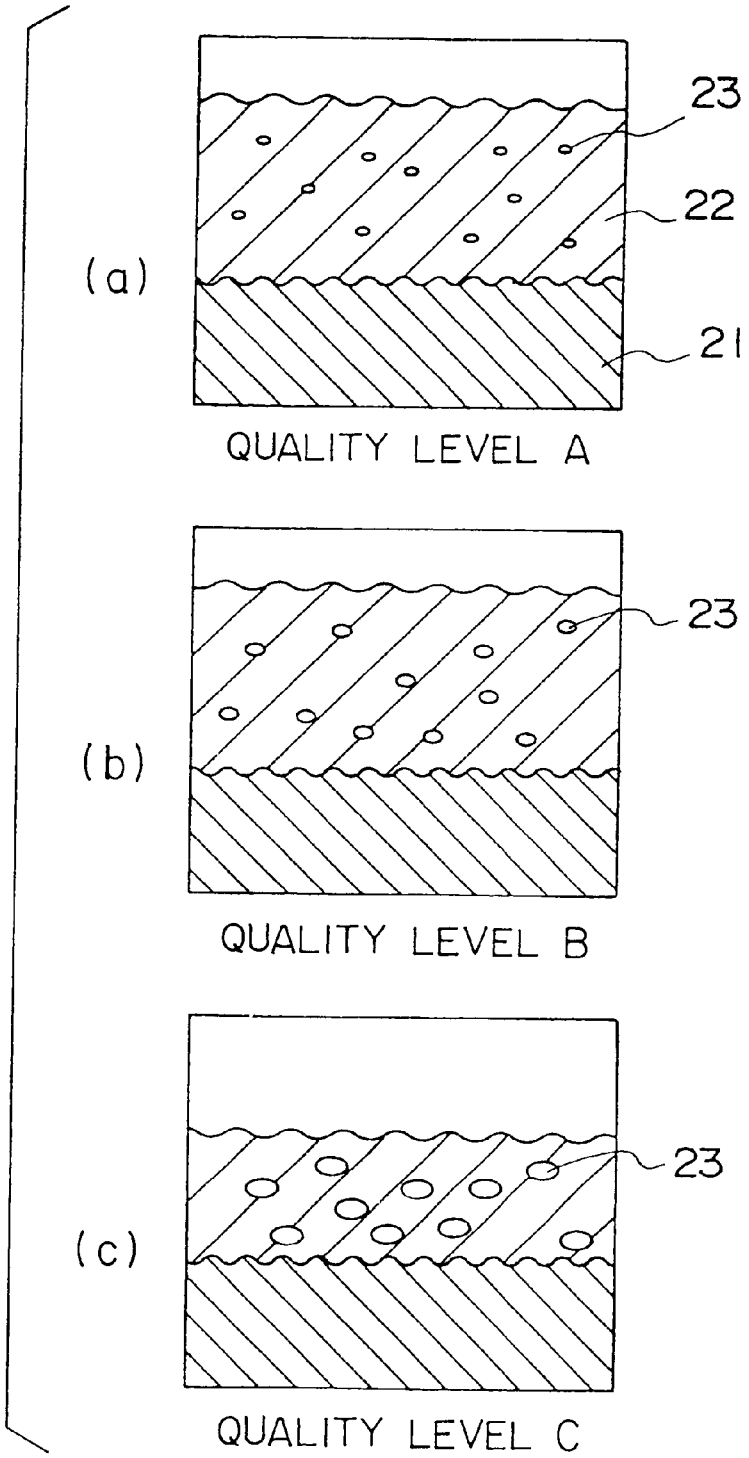
FIGS. 6(*a*), 6(*b*) and 6(*c*) are typical views of assistance in explaining the levels of quality of sprayed coatings.

FIGS. 6(*a*) to 6(*c*) are typical sectional views of sprayed coatings formed under different spray conditions, in which indicated at 21 are workpieces, at 22 are sprayed coatings and at 23 are voids.

Figure 3:
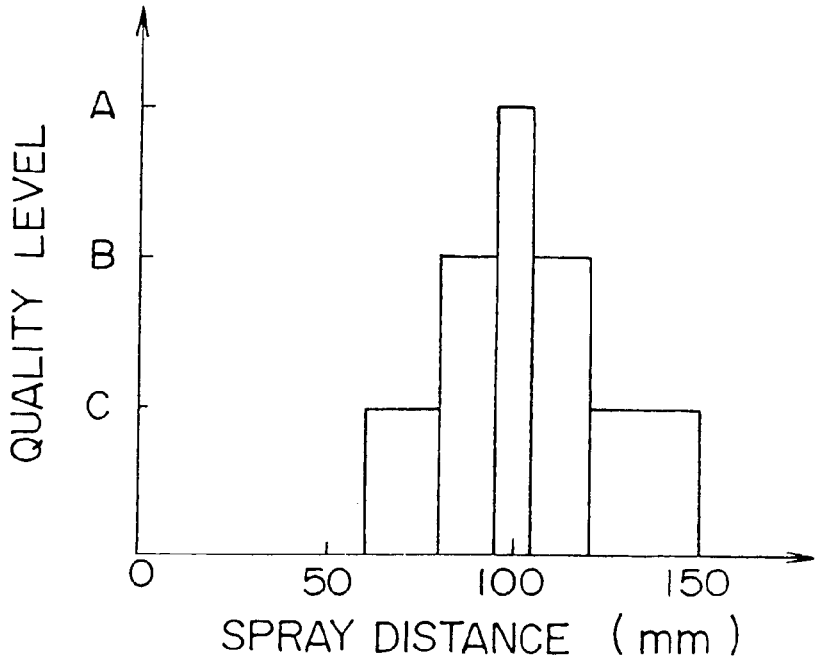
FIG. 3 is graph showing the relation between the distance between a thermal spraying gun and a workpiece, and the level of quality of a sprayed coating.
Figure 4:
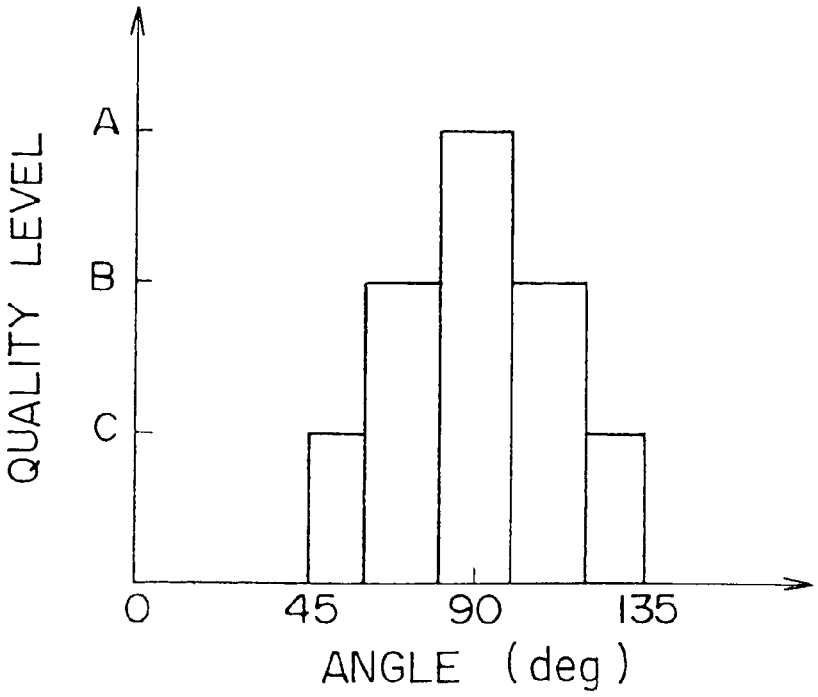
FIG. 4 is a graph showing the relation between the angle between a thermal spraying gun and a workpiece, and the level of quality of a sprayed coating.
Figure 5:
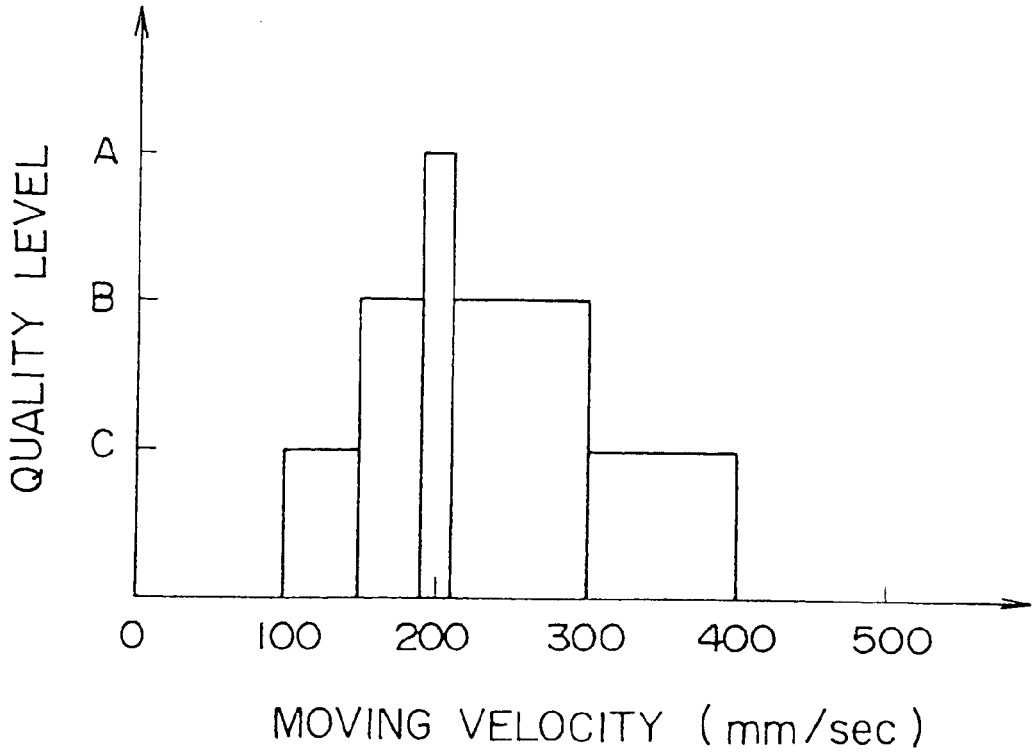
FIG. 5 is a graph showing the relation between the moving velocity of a thermal spraying gun relative to a workpiece, and the level of quality of a sprayed coating.

As shown in FIG. 6(*a*), a sprayed coating formed by a thermal spraying process meeting the optimum spray conditions A is relatively dense and has voids uniformly dispersed therein and its quality corresponds to a quality level A shown in FIGS. 3 to 5. As shown in FIG. 6(*b*), a sprayed coating formed by a thermal spraying process meeting the primary conditions B has more voids than the sprayed coating formed by the thermal spraying process meeting the optimum spray conditions A and its quality corresponding to a quality level B shown in FIGS. 3 to 5 is somewhat inferior to that of the sprayed coating formed by the thermal spraying process meeting the optimum spray conditions A. As shown in FIG. 6(*c*), a sprayed coating formed by a thermal spraying process meeting the secondary conditions C has a quality corresponding to a quality level C shown in FIGS. 3 to 5 inferior to that of the sprayed coating formed by the thermal spraying process meeting the primary conditions B. The sprayed coating shown in FIG. 6(*c*) has excessively many large voids and is thin because the yield of the thermal spraying process is low.

As shown in Tables 1 and 2, the spray parameters include distance d between the workpiece 9 and the thermal spraying gun 14 (hereinafter referred to as "spraying distance d"), velocity v of movement of the thermal spraying gun 14 relative to the workpiece 9 (hereinafter referred to as "moving velocity v"), angle θ of the spraying direction of the thermal spraying gun 14 to the surface of the workpiece 9 (hereinafter referred to as "spraying angle θ"). Spraying distance d, moving velocity v and spraying angle θ are called "principal parameters. The spray parameters include, in addition to the principal parameters, voltage applied across the positive and the negative pole of the thermal spraying gun 14 to form an electric arc (hereinafter referred to as "discharge voltage"), current supplied to the thermal spraying gun 14 to form an electric arc (hereinafter referred to as "discharge current"), flow rate of a gas for producing a plasma (argon gas) (hereinafter referred to as "plasma gas flow rate") and flow rate of an auxiliary gas (Hydrogen gas) (hereinafter referred to as "auxiliary gas flow rate").

Practically, the spray condition determining unit 5 among the foregoing components is a computer. Therefore, the path calculating unit 4 is realized in a program module that is executed by the computer. A program including such a program module is stored in a computer readable recording medium, i.e., an internal storage device, such as a memory or a hard disk included in the computer, or an external storage device, such as a flexible disk or a CD-ROM. The CPU (central processing unit) included in the computer reads and executes steps of the program sequentially to realize the following functions. When the path calculating unit 4 carries out calculation and determining steps, the internal storage device, typically, a memory included in the computer, is used for temporarily storing input data on the workpiece, input material data on the thermal spray material and calculated data.

The spray condition database 3 to be read by the path calculating program is stored in an internal storage device, such as a hard disk, or an external storage device, such as a flexible disk or a CD-ROM.

Typically, the input unit 1 includes an input device, such as a keyboard or a mouse. The input unit 1 may further be provided with a read device for reading the shape data on the shape of the workpiece (CAD data) from a recording medium, such as a flexible disk, a CD-ROM, a MO disk or a DVD, or a data receiving unit capable of directly receiving CAD data from a designing computer.

The display 2 is a CRT or a liquid crystal display.

The data transfer unit 6 for transferring data from the spray condition determining unit 5 to the thermal spraying apparatus 10 includes an output unit included in the computer, and a cable interconnecting the output unit and the robot control unit.

The data transfer unit 6 is not limited to an on-line transfer means and may be an off-line transfer means using a recording medium, such as a flexible disk, a CD-ROM, a MO disk or a DVD. If the transfer unit 6 is an off-line transfer means, the computer and the thermal spraying apparatus are provided with a recording device for recording data to the recording medium and a reproducing device for reading data from the recording medium.

The operation of the embodiment thus constructed will be described in connection with a flow chart shown in FIG. 2.

Material data, i.e., data indicating the kind of a thermal spray material is entered by operating the input unit 1 (step 101). Shape data on the shape of the workpiece is entered (step 102). Those data may be entered by operating a keyboard or by using an off-line input device, such as a floppy disk or an optical disk. These input data are stored in the internal storage device of the computer.

Subsequently, the path calculating unit 4 of the spray condition determining unit 5 fetches values conforming to the optimum spray conditions A (optimum values) for the spray parameters from the spray condition database 3 (step 103); that is, the path calculating unit 4 selects a table corresponding to the material data entered by operating the input unit 1 from each table. For example, when $Zro_2$–8% wt.$Y_2O_3$ is used, a table included in Table 1 is selected. The path calculating unit 4 selects values conforming to the optimum spray conditions A (optimum values) from the selected table.

Then, the path calculating unit 4 calculates a path for the thermal spraying gun 14 on the basis of the optimum values of the principal parameters, namely, spraying distance d, moving velocity v and spraying angle θ, among the spray parameters (step 104). The term "path" used herein signifies not only position information on the position of the thermal spraying gun 14 but also velocity information on the velocity of the thermal spraying gun 14.

The shape of a path to be calculated is determined according to the shape of the workpiece by a path calculating program to be executed by the path calculating unit 4. For example, when continuously spraying a thermal spray material on the inner surface of a workpiece having the shape of a cylinder, a circular cone or a prism, a helical path is calculated. The path calculating unit 4 calculates a path for the thermal spraying gun 14 on the basis of the shape of the determined path and the shape of the surface to be coated by thermal spraying so that the optimum values of spraying distance d, moving velocity v and spraying angle θ can be used.

As shown in Tables 1 and 2, optimum values can be selected from those in predetermined ranges. Values of the spraying distance d, moving velocity v and spraying angle θ selected from those in those ranges are used in combination for the calculation of a path for the thermal spraying gun 14. A path for the thermal spraying gun 14 is calculated in a similar manner when the values of some of the principal parameters are selected from those of the primary or the secondary conditions. Although it is preferable to calculate a path for the thermal spraying gun 14 by using fixed optimum values of the principal parameters, namely, spraying distance d, moving velocity v and spraying angle θ, values of the principal parameters need not necessarily be fixed and may be varied in the predetermined ranges of optimum values.

After the operations in step 104 have been completed, the path calculating unit 4 compares the calculated path for the thermal spraying gun 14 calculated in step 104, the shape of the thermal spraying gun 14 of the thermal spraying apparatus 10, the shape of the arm unit 15 and the shape of the workpiece 9 to decide whether or not the thermal spraying operation can actually be carried out by moving the thermal spraying gun 14 along the calculated path (step 105).

Typically, data on the respective shapes of the thermal spraying gun 14 of the thermal spraying apparatus 10, and the arm unit 15 is stored as part of a program realizing the path calculating unit 4 in the internal storage device of the computer. If the shape of the workpiece 9 is particularly complicated, a decision is made in step 105 to see whether or not the driving ability of the arm unit 15 is high enough to move the thermal spraying gun 14 along the calculated path. A method and an example of making such a decision will be explained in connection with the description of preferred embodiments.

If it is decided in step 105 that a thermal spraying operation can be carried out under the optimum spray conditions, the spray condition determining unit 5 transfers data on the spray parameters corresponding to the optimum spray conditions and the path for the thermal spraying gun 14 calculated in step 104 through the data transfer unit 6 to the robot control unit 11 of the thermal spraying apparatus 10. The data may be transferred not only by using a communication cable but may be transferred in an off-line mode using a floppy disk or an optical disk. The robot control unit 11 gives data on the path for the thermal spraying gun 14 to the robot driving unit 13 and sends values of the spray parameters other than the principal parameters to the thermal spraying control unit 12. The thermal spraying apparatus 10 moves the thermal spraying gun 14 along the path and carries out a thermal spraying operation according to the values of the spray parameters given thereto (step 106).

If it is decided in step 105 that a thermal spraying operation can not be carried out under the optimum spray conditions, the spray condition determining unit 5 makes the display 2 display information to that effect and makes a query to see which one of the principal parameters (spraying distance d, moving velocity v or spraying angle θ) is the most important parameter (hereinafter referred to as "key parameter") (step 107).

Then, the operator operates the input unit 1 to enter information about one or two selected key parameters (step 108).

Then, the path calculating unit 4 keeps the specified key parameter at the optimum value corresponding to the optimum spray conditions A, and selects values of the principal parameters other than the key parameter corresponding to the primary conditions B, i.e., allowable values, from the spray condition database 3 (step 109).

Subsequently, the path calculating unit 4 decides whether or not a thermal spraying operation can be achieved by moving the thermal spraying gun along a recalculated path calculated on the basis of the shape and ability of the thermal spraying apparatus 10, the shape of the workpiece 9 and such (step 110).

If it is decided that a thermal spraying operation specified by the newly selected values of the spray parameters is feasible, the path calculating unit 4 sends the newly selected values of the spray parameters and the calculated path for the thermal spraying gun 14 to the robot control unit 11 of the thermal spraying apparatus 10. The thermal spraying apparatus 10 carries out a thermal spraying operation according to the values of the spray parameters by moving the thermal spraying gun 14 along the path to coat the workpiece 9 with a sprayed coating (step 111).

If it is decided in step 110 that the thermal spraying operation is infeasible, the path calculating unit 4 of the spray condition determining unit 5 makes the display 2 display information to that effect (step 112), selects values of the principal parameters other than the key parameter corresponding to the secondary conditions, from the spray condition database 3 (step 113).

Subsequently, the path calculating unit 4 decides whether or not a thermal spraying operation can be achieved by moving the thermal spraying gun along a recalculated path calculated on the basis of the shape and ability of the thermal spraying apparatus 10, the shape of the workpiece 9 and such (step 114).

If it is decided that a thermal spraying operation specified by the newly selected values of the spray parameters is feasible, the path calculating unit 4 sends the newly selected values of the spray parameters and the calculated path for the thermal spraying gun 14 to the robot control unit 11 of the thermal spraying apparatus 10. The thermal spraying apparatus 10 carries out a thermal spraying operation according to the values of the spray parameters by moving the thermal spraying gun 14 along the path to coat the workpiece 1 with a sprayed coating (step 115).

If it is decided that the thermal spraying operation is infeasible, the path calculating unit 4 of the spray condition determining unit 5 makes the display 2 display information to that effect (step 116), and makes a query to see if the operator has an intention to change the values of the key parameter (step 117).

If the operator decides that the value of the key parameter be changed, steps 108 to 116 are repeated to change the optimum value of the key parameter, and, if a thermal spraying operation under thus determined spray conditions is feasible, the spray condition determining unit 5 sends the readjusted values of the spray parameters and a calculated path for the thermal spraying gun 14 through the data transfer unit 6 to the robot control unit 11 of the thermal spraying apparatus 10. The thermal spraying apparatus 10 carries out a thermal spraying operation according to the values of the spray parameters given thereto by moving the thermal spraying gun 14 along the path to coat the workpiece 9 with a sprayed coating.

If it is decided that a thermal spraying operation defined by spray conditions determined by changing the value of the key parameter and executing steps 108 to 116 is infeasible (step 114), the path calculating unit 4 selects values of all the principal parameters from those of the primary or the secondary conditions, and recalculates a path for the thermal spraying gun 14 (step 118). Step 118 is executed also when it is decided in step 117 that the value of the key parameter be not changed.

Subsequently, the path calculating unit 4 decides whether or not a thermal spraying operation is feasible under spray conditions calculated in step 118 (step 119). If it is decided that the thermal spraying operation is feasible, the spray condition determining unit 5 sends the readjusted values of the spray parameters and a calculated path for the thermal spraying gun 14 through the data transfer unit 6 to the robot control unit 11 of the thermal spraying apparatus 10. The thermal spraying apparatus 10 carries out a thermal spraying operation according to the values of the spray parameters given thereto by moving the thermal spraying gun 14 along the path to coat the workpiece 9 with a sprayed coating (step 120).

If it is decided in step 119 that the thermal spraying operation is infeasible, the path calculating unit 4 displays information to that effect and recalculates a possible path for the thermal spraying gun 14 (step 121). In step 121 the calculation of a path is carried out even if the values of the principal parameters (spraying distance d, moving velocity v and spraying angle θ) are other than those for the secondary conditions.

The values of the principal parameters used in the calculation of the path are displayed by the display 2 and a query is made to the operator to prompt the operator to decide whether or not the thermal spraying operation be carried out according to the values of the principal parameters (step 122).

If the operator decides that the thermal spraying operation according to those values of the spray parameters may be carried out (step 123), the operator operates the input unit 1 to enter an instruction to that effect. Then the spray condition determining unit 5 sends the values of the spray parameters to the robot control unit 11, and the thermal spraying operation is carried out by moving the thermal spraying gun along the calculated path according to the values of the spray parameters (step 124).

If the operator decides that the thermal spraying operation according to the thus selected values of the spray parameters is unacceptable, the thermal spraying operation is not executed (step 125).

The following changes may be made in the foregoing flow chart. This embodiment executes the thermal spraying operation immediately when it is decided in step 110, 114 or 119 that the thermal spraying operation is feasible (steps 111, 115, 120). A step for making the operator decide whether or not the thermal spraying operation is executed may be interposed between steps 110 and 111, between steps 114 and 115 and/or between steps 119 and 120.

Although this embodiment coats the entire surface of the workpiece 9 by thermal spraying under the substantially fixed spray conditions, the surface of the workpiece 9 may be divided into a plurality of regions, and different spray conditions may be determined for different regions by using different values of the principal parameters, such as the optimum values for a first region and values of the secondary conditions for a second region, which will be explained in connection with the description of second to fourth embodiments.

As is apparent from the foregoing description, the foregoing embodiment is capable of automatically determining spray conditions according to the shape of a workpiece and of significantly reducing time necessary for the development of a thermal spraying program.

EXAMPLES

Concrete examples of spray condition determining processes will be described hereinafter. The following description will be made on an assumption that a thermal spray material is $ZrO_2$–8% wt.$Y_2O_3$. Step numbers used in the following description correspond to the numbers of the steps of the flow chart shown in FIG. 2, respectively.

Example 1

Figure 7:
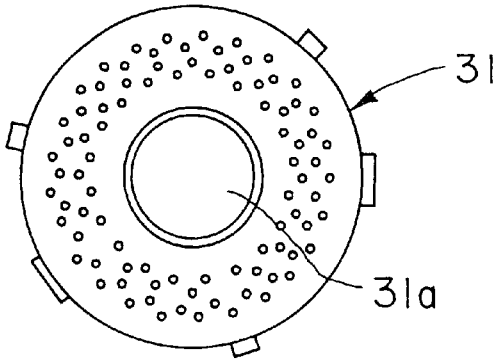
FIGS. 7(*a*) and 7(*b*) are a plan view and a side elevation, respectively, of a liner for a combustor, i.e., a workpiece, in Example 1.
Figure 7:
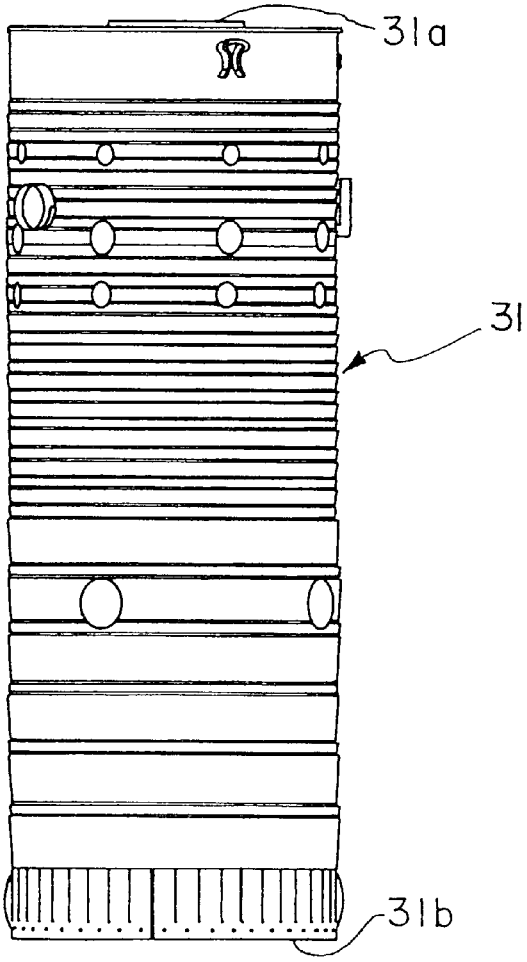

Example 1 will be described with reference to FIG. 7. Shown in FIG. 7 is a combustor liner 31, i.e., a workpiece, for a gas turbine power plant. The combustor liner 31 has a generally cylindrical shape. The combustor liner 31 is provided at one end thereof with an opening 31*a* of a diameter smaller than the inside diameter thereof and at the other end thereof with an opening 31*b* of a diameter equal to the inside diameter thereof. The inside diameter of the combustor liner 31 is dependent on the power generating ability of the gas turbine power plant; the inside diameter is great for a large output or is small for a small output.

When coating the inner surface of the combustor liner 31 with a heat shield, the inner surface is subjected to a blasting process, the inner surface is coated with a metal layer, and a ceramic layer is formed over the metal layer. When coating the inner surface, the thermal spraying gun 14 is inserted through the opening 31*b* into a central region of the interior of the combustor liner 31, and the thermal spraying gun 14 or the combustor liner 31 is turned to coat the inner surface of the combustor liner 31.

Figure 2:
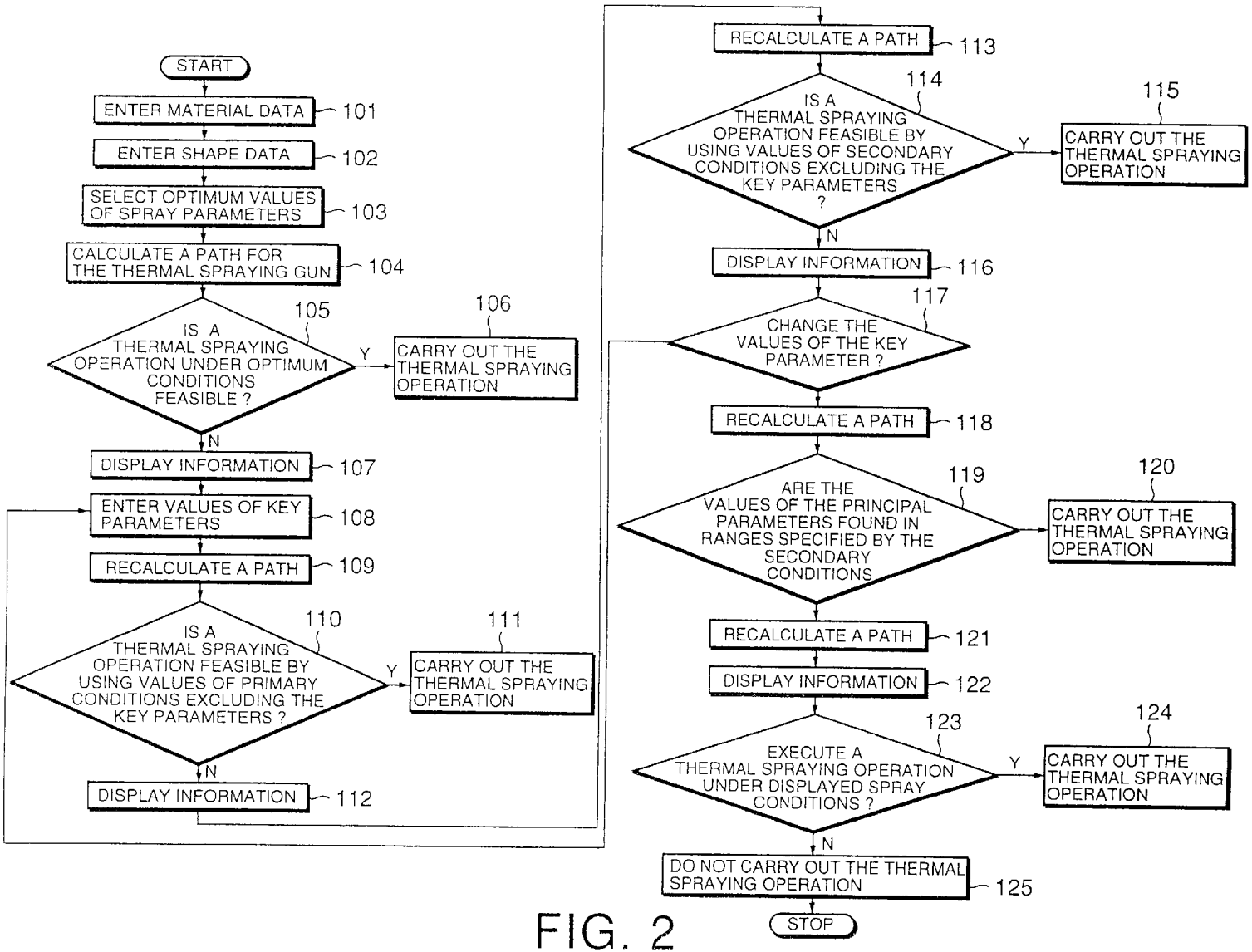
FIG. 2 is a flow chart of an operation to be carried out by the thermal spraying robot system.

When coating the inner surface of the combustor liner 31 by thermal spraying, a spray condition determining process was carried out according to the flow chart shown in FIG. 2.

Since the combustor liner 31, i.e., the workpiece, has a shape rotationally symmetric with respect to a predetermined axis, the path calculating unit 4 calculated a path for the thermal spraying gun 14 in step 104 to move the thermal spraying gun 14 helically with respect to the inner surface of the combustor liner 31.

Consequently, it was decided in step 105 that the thermal spraying operation cannot be carried out with the spraying distance d fixed at the optimum value, because the inside diameter of the combustor liner 31 for a gas turbine of an output capacity on the order of 15,000 kW is on the order of 200 mm and the thermal spraying gun 14 cannot be held at the optimum value of spraying distance d in the range of 95 to 100 mm in the combustor liner 31 owing to its actual dimensions and the shape of the arm unit 15.

In this case, the operator selected moving velocity v and spraying angle θ as key parameters by operating the input unit 1 (step 108). Then, a path for the thermal spraying gun 14 was recalculated automatically (step 109) and it was ascertained that a thermal spraying operation under conditions shown in Table 3, in which optimum values of moving velocity v and spraying angle θ can be used when the spraying distance d is 80 mm included in the primary conditions (step 110).

The combustor liner 31, i.e., the workpiece, has a shape rotationally symmetric with respect to a predetermined axis and the shape is fixed with respect to a direction along the axis. Therefore, the entire inner surface of the combustor liner 31 could be coated with a sprayed coating formed under the same spray conditions.

TABLE 3

Spray Condition For Combustor Liner

| Spray Parameters | Values |
|---|---|
| Spray distance (mm) | 80 |
| Moving velocity (mm/s) | 200 |
| Spraying angle (deg) | 90 |
| Current (A) | 600 |
| Voltage (V) | 60 |
| Plasma gas: Ar (l/min) | 40 |
| Auxiliary gas: $H_2$ (l/min) | 7 |

Example 2

Figure 8A:
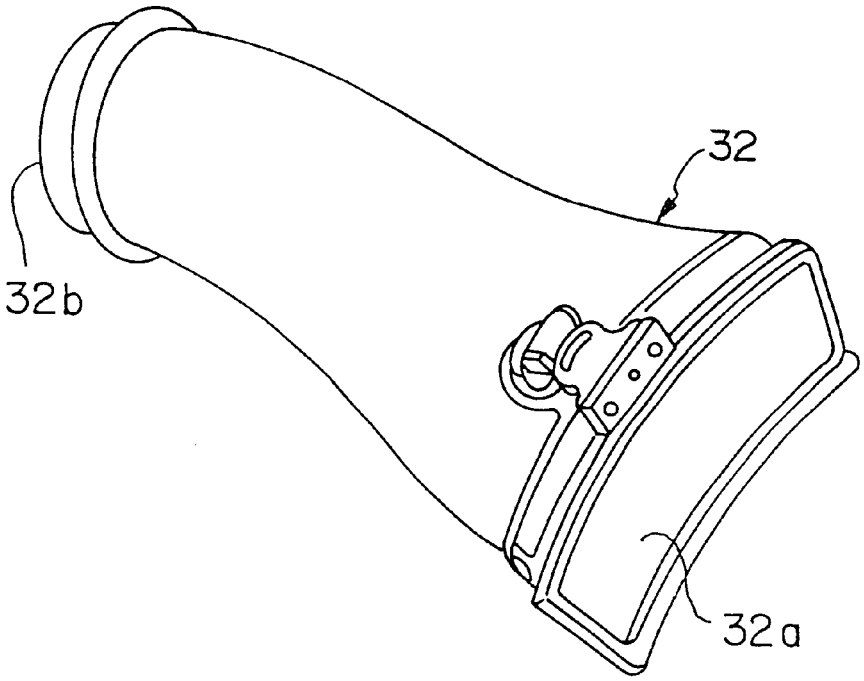
FIGS. 8(*a*) and 8(*b*) are a perspective view and a partly cutaway side elevation, respectively, of a transition piece, i.e., a workpiece, in Example 2.
Figure 8B:
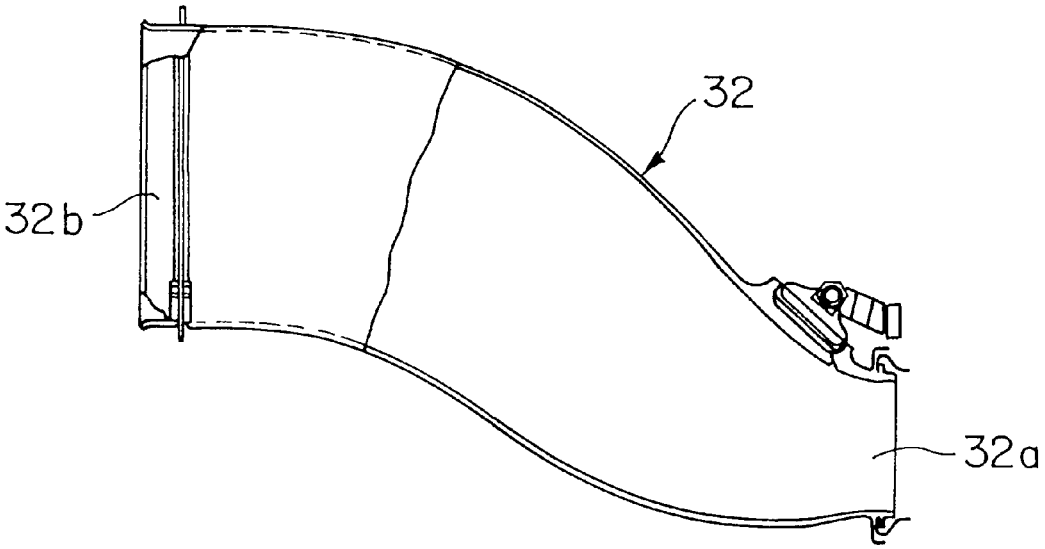

Example 2 will be described with reference to FIG. 8. Shown in FIG. 8 is a transition piece 32 serving as a component part of a gas turbine power plant. The transition piece 32 has opposite open ends 32*a* and 32*b* (an inlet and an outlet). As shown in FIG. 8(*b*), the transition piece 32 has a curved inner surface of varying curvature and different parts of the transition piece 32 have different cross sections.

The spray condition determining process including steps 101 to 105 of the flow chart shown in FIG. 2 was executed to coat the inner surface of the transition piece 32 with a sprayed coating. It was decided that a sprayed coating cannot be formed over a middle region of the inner surface of the transition piece 32 by a thermal spraying operation using optimum values of spraying distance d, moving velocity v and spraying angle θ.

The principal reason the thermal spraying operation cannot be carried out for the middle region of the inner surface of the transition piece 32 was that the arm unit 15 holding the thermal spraying gun 14 collides against the brim of the open end of the transition piece 32 when the thermal spraying gun 14 is inserted through either the open end 32*a* or the open end 32*b* into the transition piece 32. It was possible to carry out the thermal spraying operation using the optimum values of spraying distance d, moving velocity v and spraying angle θ for regions of the inner surface near the open ends 32*a* and 32*b*.

The spray conditions were kept unchanged for the regions of the inner surface near the open ends 32*a* and 32*b*, and step 107 and the following steps were executed to determine spray conditions for the middle region of the inner surface of the transition piece 32.

Allowable values (the secondary conditions) of the three key parameters were selected and a path along which the thermal spraying gun 14 is to be moved to coat the middle region of the inner surface of the transition piece 32 was recalculated (step 118), paths for the thermal spraying gun which enable thermal spraying operations under spray conditions shown in Table 4 could be calculated.

Different values of the parameters were used for coating the regions of the inner surface near the inlet and the outlet (open-ends 32*a* and 32*b*) of the transition piece 32 shown in FIG. 8(*b*), and the middle region of the inner surface, respectively (step 119).

TABLE 4

| Spray Condition For Transition Piece | | |
|---|---|---|
| Spray Parameters | Values For Inlet and Outlet Region | Values for Middle Region |
| Spray distance (mm) | 100 | 60 |
| Moving velocity (mm/s) | 200 | 350 |
| Spraying angle (deg) | 90 | 70 |
| Current (A) | 600 | 600 |
| Voltage (V) | 60 | 60 |
| Plasma gas: Ar (l/min) | 40 | 40 |
| Auxiliary gas: $H_2$ (l/min) | 7 | 7 |

Example 3

Figure 9:
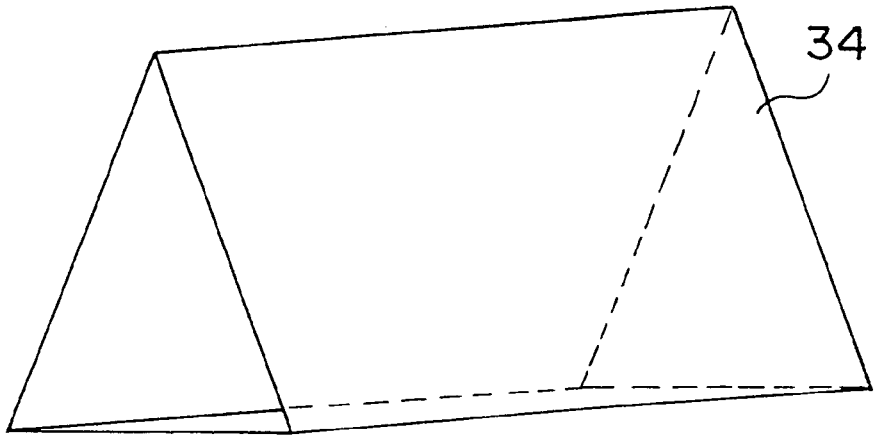
FIG. 9 is a perspective view of a workpiece having the shape of a triangular prism in Example 3.

Example 3 will be described with reference to FIG. 9. Shown in FIG. 3 is a workpiece 34 resembling a triangular prism having opposite open ends. When coating the inner surface of the workpiece 34 resembling a triangular prism with a sprayed coating, the spraying angle θ of the thermal spraying gun 14 cannot be kept at an optimum angle of 90° and the values of spraying angle θ needs to be varied during a thermal spraying operation. Feasible spray conditions shown in Table 5 were determined by calculating a path for the thermal spraying gun 14 by specifying spraying distance between the thermal spraying gun 14 and the workpiece as a key parameter.

Different spray conditions were determined for coating end regions of the inner surface and for coating a middle region of the same, respectively. The spray conditions for the end regions include an optimum value for spraying distance d, an allowable value included in the secondary conditions for moving velocity v, and a value included in the primary conditions for spraying angle θ. Thus, the spraying conditions were determined by steps 101 to 114 of the operation expressed by the flow chart shown in FIG. 2.

The spray conditions for the middle region include a value included in the secondary conditions for spraying distance d, a value included in the secondary conditions for moving velocity v, and a value outside the range of values included in the secondary conditions for spraying angle θ. Thus, the spraying conditions were determined by steps 101 to 123 of the operation expressed by the flow chart shown in FIG. 2.

TABLE 5

| Spray Condition For Triangular Prism | | |
|---|---|---|
| Spray Parameters | Values For Inlet and Outlet Region | Values for Middle Region |
| Spray distance (mm) | 100 | 70 |
| Moving velocity (mm/s) | 200–350 | 100 |
| Spraying angle (deg) | 60–90 | 40 |
| Current (A) | 600 | 800 |
| Voltage (V) | 60 | 80 |

TABLE 5-continued

| Spray Condition For Triangular Prism | | |
|---|---|---|
| Spray Parameters | Values For Inlet and Outlet Region | Values for Middle Region |
| Plasma gas: Ar (l/min) | 40 | 40 |
| Auxiliary gas: $H_2$ (l/min) | 7 | 7 |

Example 4

Figure 10:
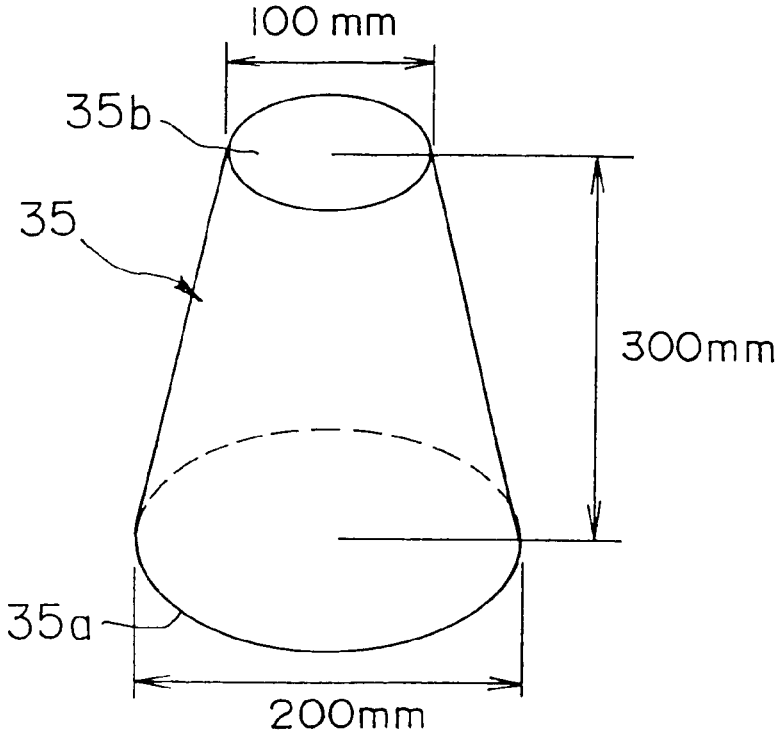
FIG. 10 is a perspective view of a frustum-shaped workpiece in Example 4.

Example 4 will be described with reference to FIG. 10. Shown in FIG. 10 is a frustum-shaped workpiece 35. Numerical values indicated along with lines on FIG. 10 describe inside measurements of the frustum-shaped workpiece 35.

Since the frustum-shaped workpiece 35 is rotationally symmetric with respect to a predetermined axis, the path calculating unit 4 calculated a helical path for the thermal spraying gun 14 in step 104 so that the thermal spraying gun 14 is moved helically relative to the inner surface of the frustum-shaped workpiece 35.

The calculation showed that the a thermal spraying operation can be carried out for a region near a bottom surface 35*a* under spray conditions using an optimum value of spraying angle θ, and values included in the primary conditions of spraying distance d and moving velocity v (step 110).

However, the thermal spraying gun 14 could not be spaced the selected value of spraying distance apart from the a region of the inner surface near the smaller end 35*b*. Therefore, the system decided that the a thermal spraying operation cannot be carried out even if a path for the thermal spraying gun 14 is recalculated by using values of spraying distance d, moving velocity v and spraying angle θ included in the secondary conditions (step 119 in the flow chart shown in FIG. 2).

The display 2 displayed information telling that a thermal spraying operation can be achieved if the spraying distance between the thermal spraying gun and the workpiece is 50 mm (step 122). If the operator accepts the information displayed by the display 2 (step 123), a thermal spraying operation can be carried out under spray conditions including values tabulated in Table 6.

TABLE 6

| Spray Condition For Frustum | | |
|---|---|---|
| Spray Parameters | Values For Inlet and Outlet Region | Values for Middle Region |
| Spray distance (mm) | 50 | 80 |
| Moving velocity (mm/s) | 500 | 150 |
| Spraying angle (deg) | 90 | 80 |
| Current (A) | 600 | 600 |
| Voltage (V) | 60 | 60 |
| Plasma gas: Ar (l/min) | 40 | 40 |
| Auxiliary gas: $H_2$ (l/min) | 7 | 7 |

Although the present invention has been described in its preferred embodiment and examples, the present invention is not limited thereto in its practical application and various changes and modifications may be made therein without departing from the scope and spirit thereof as set forth in appended claims.

What is claimed is:

1. A thermal spraying method using a thermal spraying apparatus provided with a thermal spraying gun, and a computer for determining spray conditions, said thermal spraying method comprising the steps of:

(a) entering shape data on the shape of a workpiece into the computer;

(b) determining a set of values of spray parameters and a path of the spraying gun, the determining step including the steps of:

(i) selecting representative values of the spray parameters from a spray condition database of the computer, which stores a plurality of values for each of the spray parameter;

(ii) calculating a path for the thermal spraying gun on the basis of the values of the spray parameters selected in the step (i) and the shape data on the workpiece according to a program stored in the computer;

(iii) deciding whether or not thermal spraying can be carried out by moving the thermal spraying gun along the path calculated in the step (ii) according to the program stored in the computer; and (iv) repeating, if it is decided that thermal spraying can not be carried out in the step (iii), the steps (i), (ii) and (iii) at least once, while changing at least one of the value of the parameters used in the previously executed step (i), the changed value of the parameter being selected from values stored in the spray condition database; and (c) carrying out a thermal spraying operation on the basis of the values of the spray parameters and the path for the thermal spraying gun determined in the step (b), wherein the set of values selected in step (i) at a beginning of the step (b) are optimum values specifying on optimum spray condition, under which dense sprayed coating can be obtained, and wherein the set of values including the at least one value changed in the step (iv) specifies a spray condition under which a sprayed coating containing more or larger voids than those contained in the sprayed coating sprayed under the optimum condition, wherein the spray parameters include:

spray distance d between the workpiece and the thermal spraying gun;

angle θ between the thermal spraying gun and the workpiece; and moving velocity v of the thermal spraying gun relative to the workpiece, wherein, at least one of the spray distance d, the angle θ and the moving velocity v is changed in the step (iv), and wherein the determining step (b) including the steps of:

(v) displaying, on a display of the computer, a decision of the step (iii), and requesting from an operator which parameter amongst the spray distance d, the angle θ and the moving velocity v should be maintained or changed in the step (iv); and (vi) inputting, by the operator into the computer, at least one parameter amongst the spray distance d, the angle θ and the moving velocity v that should be maintained or changed;

wherein the steps (v) and (vi) are carried out after the step (iii) and before the step (iv).

* * * * *